US012268316B2

(12) United States Patent
Lavin

(10) Patent No.: US 12,268,316 B2
(45) Date of Patent: Apr. 8, 2025

(54) UMBRELLA STAND ASSEMBLY

(71) Applicant: Tom Lavin, Minneapolis, MN (US)

(72) Inventor: Tom Lavin, Minneapolis, MN (US)

( * ) Notice: Subject to any disclaimer, the term of this patent is extended or adjusted under 35 U.S.C. 154(b) by 216 days.

(21) Appl. No.: 18/104,846

(22) Filed: Feb. 2, 2023

(65) Prior Publication Data

US 2024/0260725 A1 Aug. 8, 2024

(51) Int. Cl.

| | |
|---|---|
| ***A47G 33/12*** | (2006.01) |
| ***E04H 12/22*** | (2006.01) |
| *A45B 23/00* | (2006.01) |

(52) U.S. Cl.

CPC ..... *A47G 33/12* (2013.01); *E04H 12/22* (2013.01); *A45B 2023/0012* (2013.01); *A47G 33/1213* (2013.01); *E04H 12/2238* (2013.01)

(58) Field of Classification Search

CPC ..... A47G 33/1213; A47G 33/1206; E04H 12/22; E04H 12/2238

See application file for complete search history.

(56) References Cited

U.S. PATENT DOCUMENTS

| | | | | |
|---|---|---|---|---|
| 5,707,037 | A * | 1/1998 | Pastrick | A47G 33/1213 248/516 |
| 6,854,700 | B2 * | 2/2005 | Schmitz | A47G 33/1213 248/525 |
| 6,877,708 | B1 * | 4/2005 | Thurner | A47G 33/1213 248/519 |
| 6,988,702 | B2 * | 1/2006 | Schulz | A47G 33/1213 248/525 |
| 7,246,783 | B2 | 7/2007 | Harold | |
| 7,341,234 | B2 * | 3/2008 | Kowalski | A47G 33/1213 248/525 |
| 7,484,703 | B2 * | 2/2009 | Krinner | A47G 33/1213 D11/130.1 |
| 7,484,704 | B2 * | 2/2009 | Schommertz | A47G 33/1213 248/525 |
| 10,694,879 | B2 * | 6/2020 | Wach | A47G 33/1226 |
| 2002/0005466 | A1 * | 1/2002 | Thurner | A47G 33/1213 248/519 |
| 2004/0065802 | A1 | 4/2004 | Clasen | |
| 2014/0182639 | A1 | 7/2014 | Wise | |
| 2015/0076313 | A1 | 3/2015 | Ma | |
| 2017/0114563 | A1 | 4/2017 | Ye | |
| 2023/0263327 | A1 * | 8/2023 | Beckers | E04H 12/2238 248/523 |

FOREIGN PATENT DOCUMENTS

| | | | | |
|---|---|---|---|---|
| CN | 201982912 | | 9/2011 | |
| DE | 2814830 | A1 * | 10/1979 | A47G 33/1213 |

* cited by examiner

*Primary Examiner* — Noah Chandler Hawk

(57) ABSTRACT

An umbrella stand assembly includes a base that is positionable on a support surface and the base has an opening for insertably receiving a pole of an umbrella. A gripping unit is movably integrated into the base and the gripping unit is biased to engage the pole of the umbrella for retaining the pole in the base. The gripping unit is urgeable to disengage the pole thereby facilitating the pole to be removed from the base. A foot pedal is movably attached to the gripping unit and the foot pedal is stepped upon to urge the gripping unit into the releasing position. In this way the gripping unit is disengaged from the pole without requiring the user to bend over to manipulate the gripping unit.

10 Claims, 9 Drawing Sheets

UMBRELLA STAND ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to umbrella devices and more particularly pertains to a new umbrella device for quickly securing an umbrella into a base. The device includes a base and a gripping unit movably integrated into the base. The base insertably receives a pole of the umbrella and the gripping unit is biased to engage the pole. The device includes a foot pedal that is pivotally attached to the gripping unit for urging the gripping unit to disengage the pole.

(2) Description of Related Art Including Information Disclosed Under 37 CFR 1.97 and 1.98

The prior art relates to umbrella devices including a mobile base with a telescopic foot pedal. The prior art discloses an umbrella base that includes an auger for penetrating sand at a beach. The prior art discloses an umbrella stand that includes a sleeve and a foot peg attached to the sleeve to assist with driving the sleeve into the ground. The prior art discloses an umbrella mount that includes a pneumatic piston for lifting or lowering an umbrella. The prior art discloses an umbrella stand that includes a socket rotatably disposed on a base and a foot pedal attached to the socket for unlocking the socket.

BRIEF SUMMARY OF THE INVENTION

An embodiment of the disclosure meets the needs presented above by generally comprising a base that is positionable on a support surface and the base has an opening for insertably receiving a pole of an umbrella. A gripping unit is movably integrated into the base and the gripping unit is biased to engage the pole of the umbrella for retaining the pole in the base. The gripping unit is urgeable to disengage the pole thereby facilitating the pole to be removed from the base. A foot pedal is movably attached to the gripping unit and the foot pedal is stepped upon to urge the gripping unit into the releasing position. In this way the gripping unit is disengaged from the pole without requiring the user to bend over to manipulate the gripping unit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
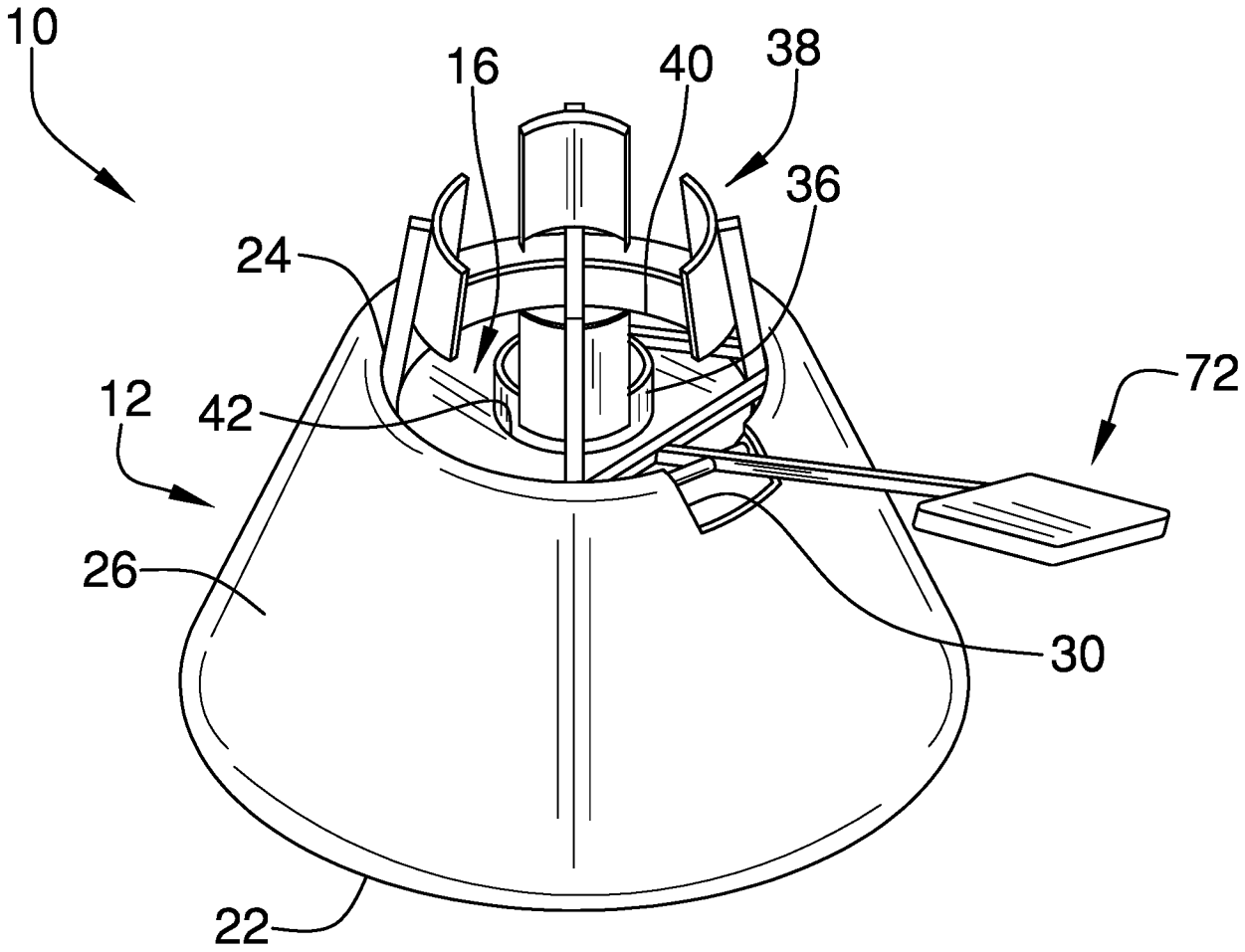
FIG. 1 is a top perspective view of an umbrella stand assembly according to an embodiment of the disclosure showing a gripping unit in a releasing position.
Figure 2:
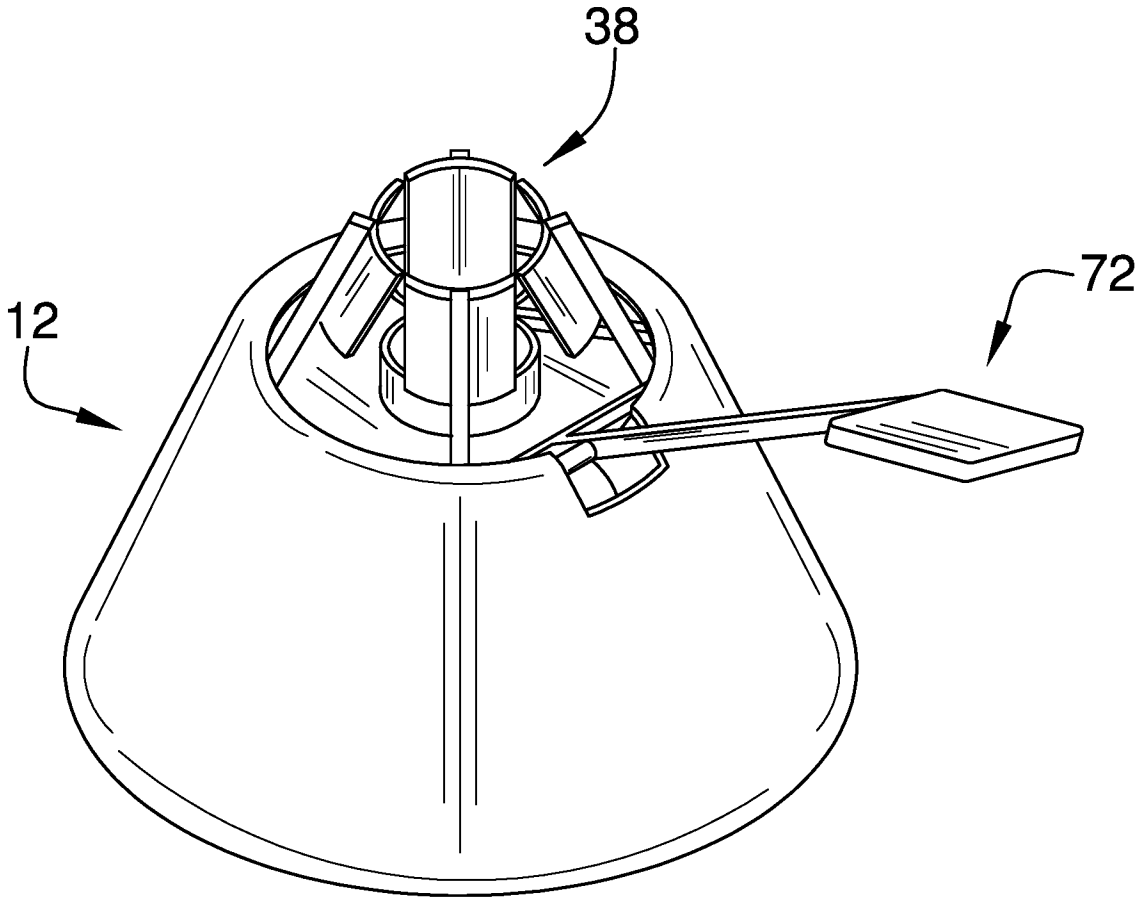
FIG. 2 is a top perspective view of an embodiment of the disclosure showing a gripping unit is a gripping position.
Figure 3:
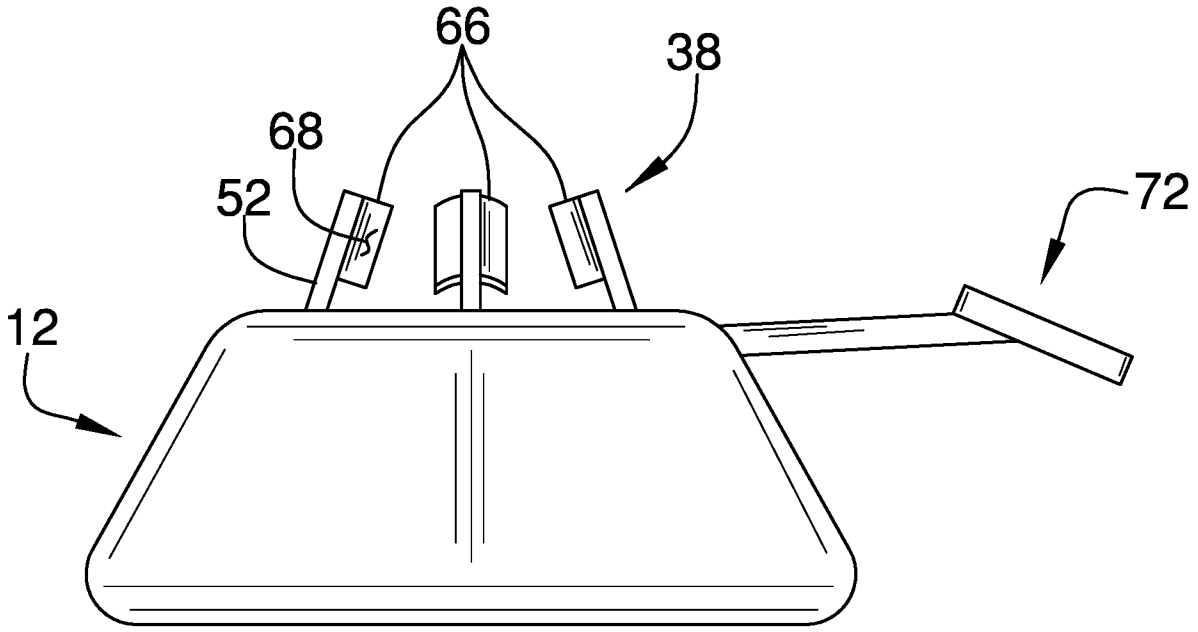
FIG. 3 is a left side view of an embodiment of the disclosure.
Figure 4:
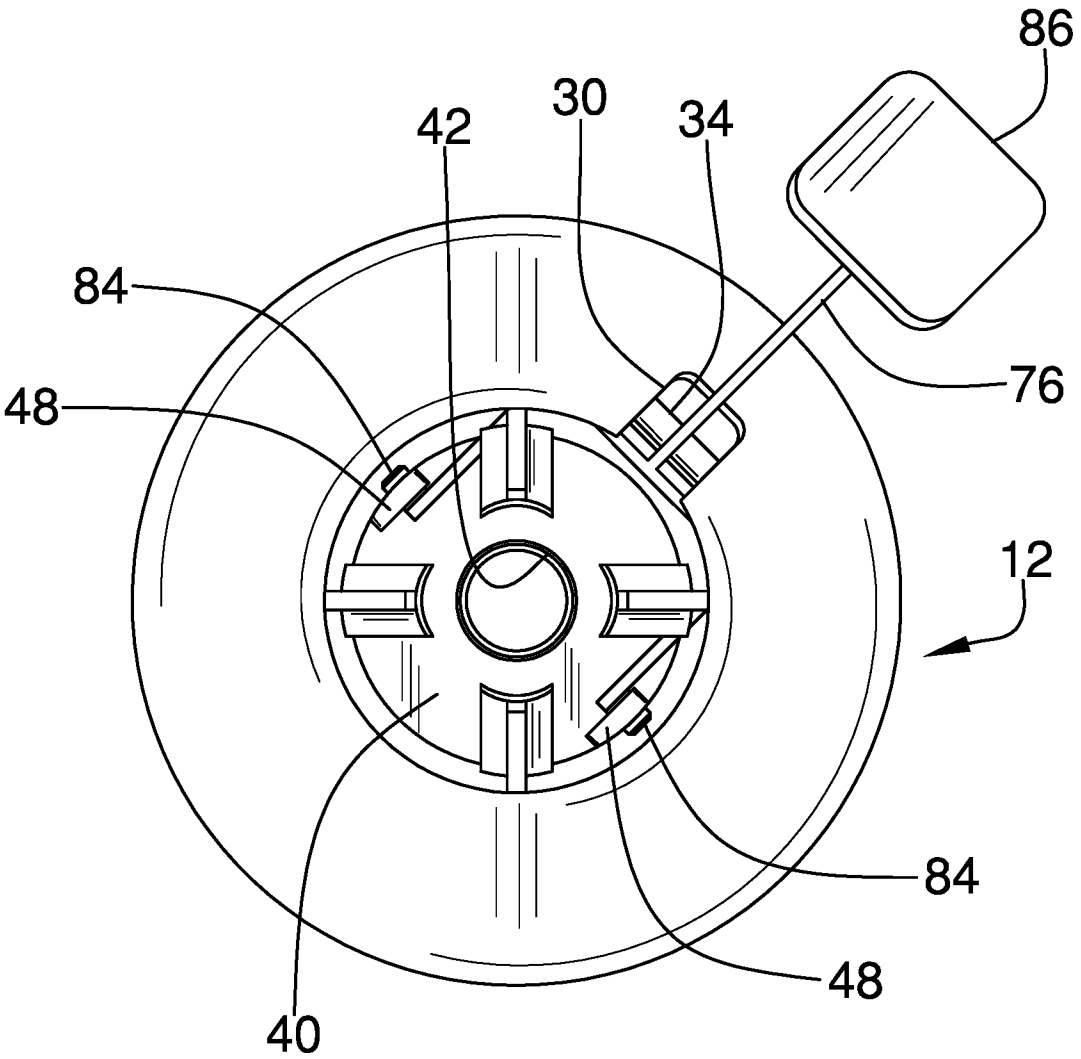
FIG. 4 is a top view of an embodiment of the disclosure.
Figure 5:
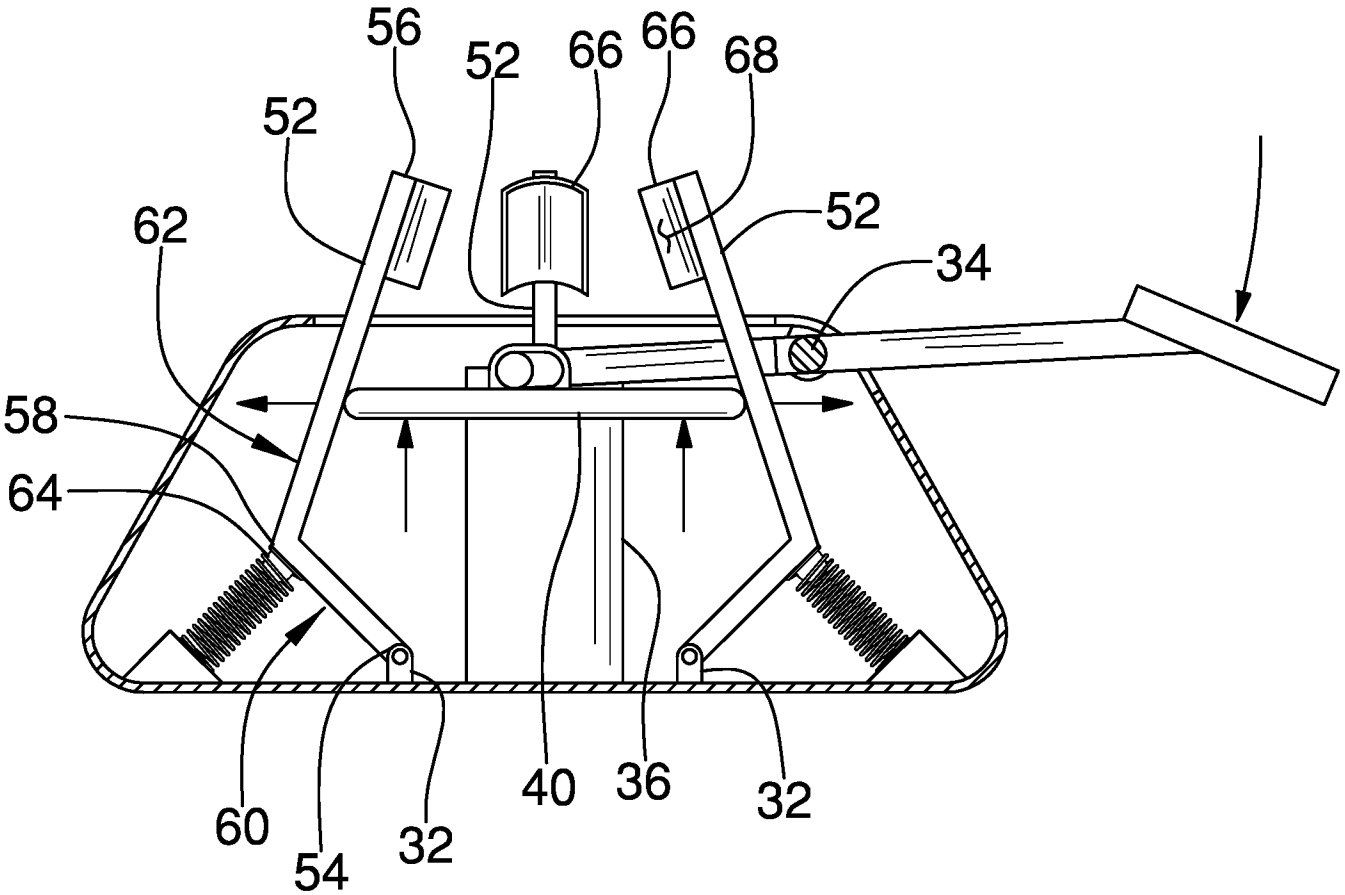
FIG. 5 is a left side cut-away view of an embodiment of the disclosure showing a gripping unit being urged into a releasing position.
Figure 6:
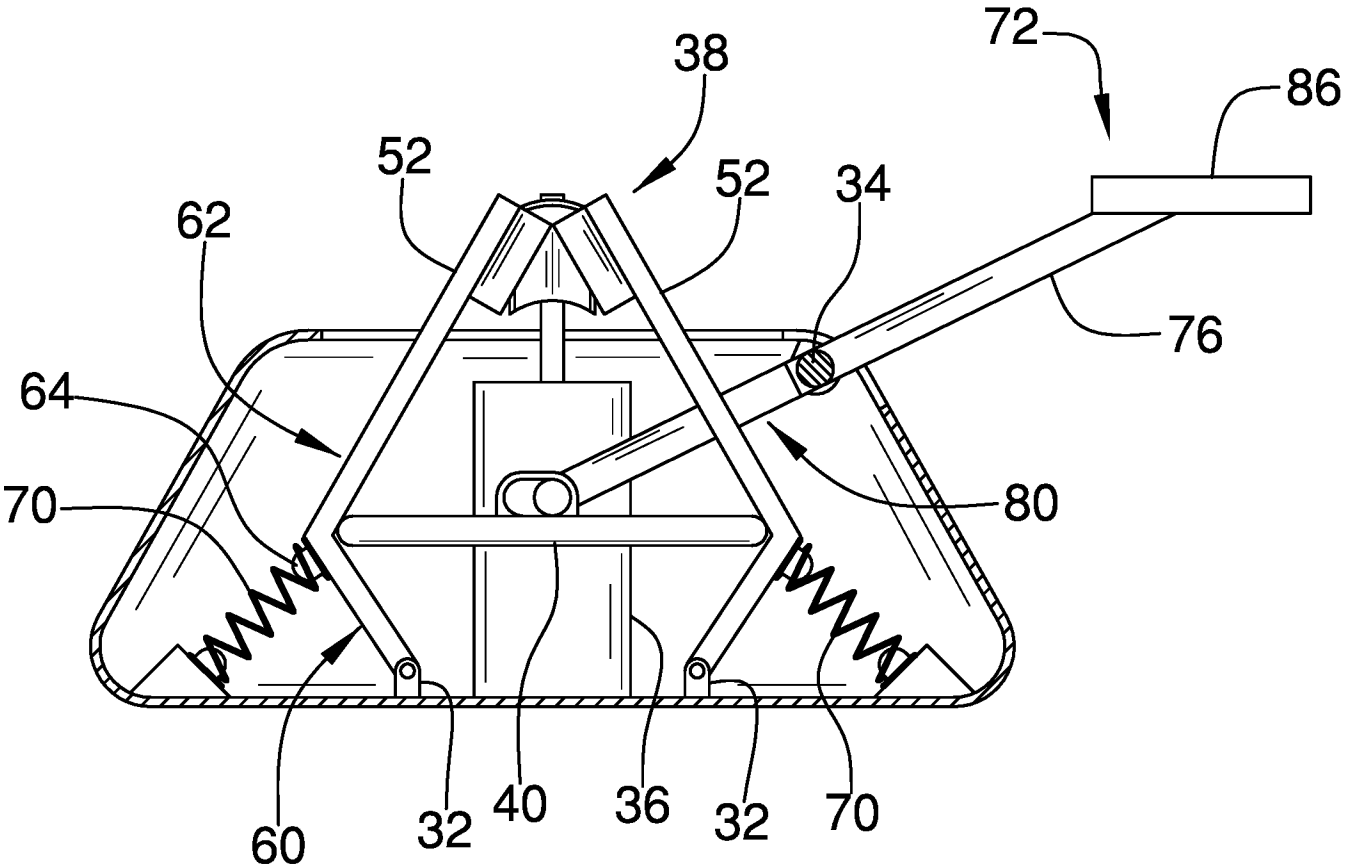
FIG. 6 is a left-side cut-away view of an embodiment of the disclosure showing a gripping unit being biased into a gripping position.
Figure 7:
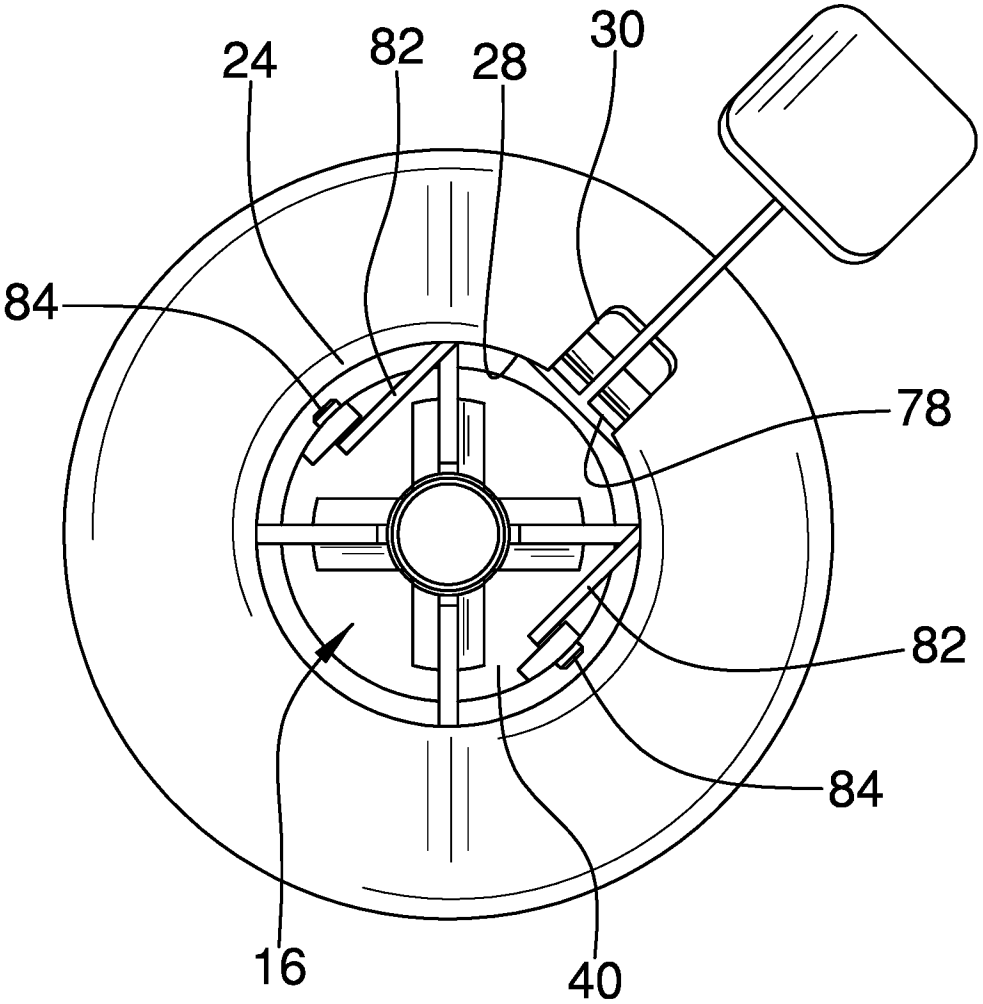
FIG. 7 is a top view of an embodiment of the disclosure.
Figure 8:
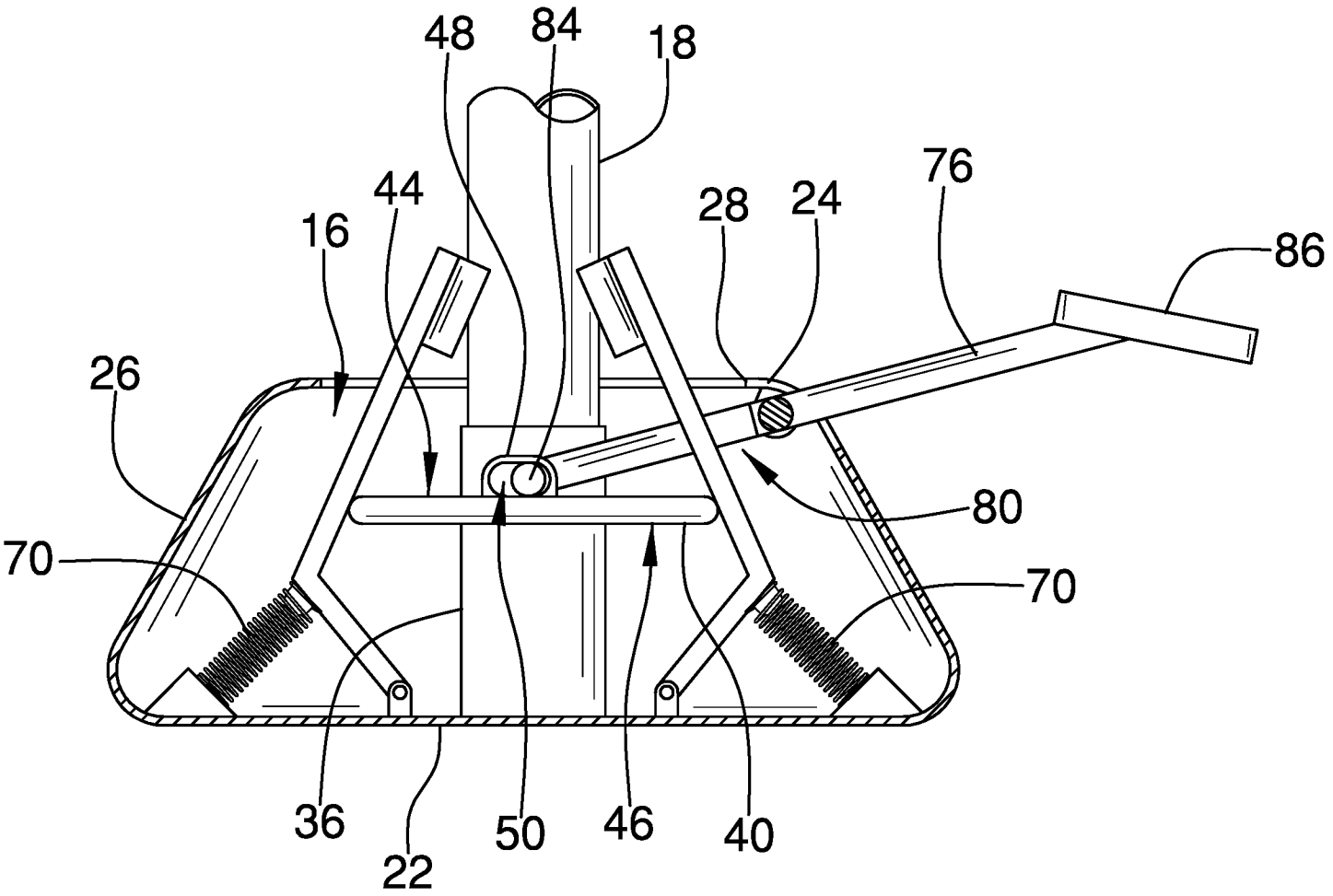
FIG. 8 is a cut-away in-use view of an embodiment of the disclosure.
Figure 9:
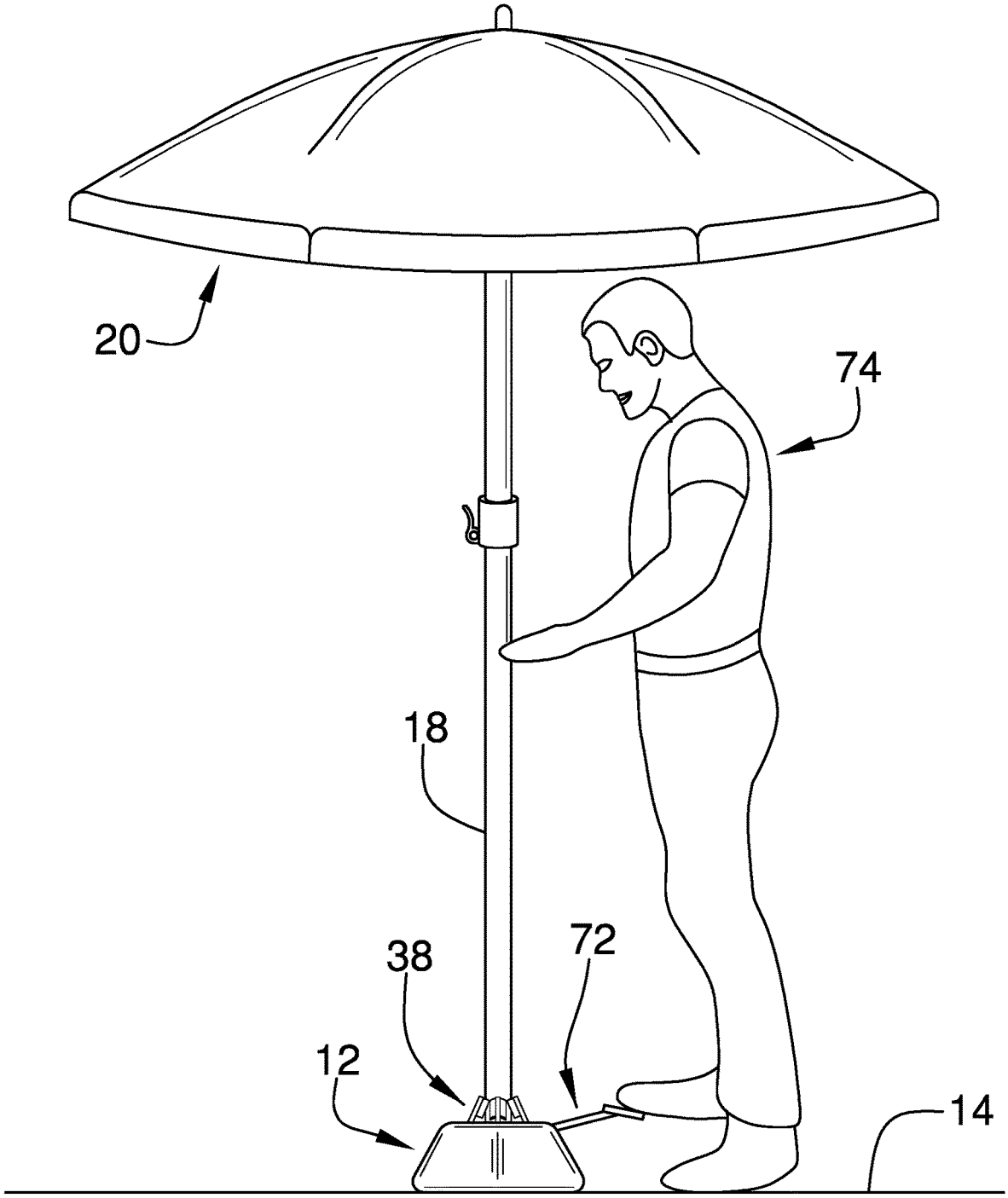
FIG. 9 is a perspective in-use view of an embodiment of the disclosure.

With reference now to the drawings, and in particular to FIGS. 1 through 9 thereof, a new umbrella device embodying the principles and concepts of an embodiment of the disclosure and generally designated by the reference numeral 10 will be described.

As best illustrated in FIGS. 1 through 9, the umbrella stand assembly 10 generally comprises a base 12 that is positionable on a support surface 14 such that a floor or other horizontal support surface. The base 12 has an opening 16 for insertably receiving a pole 18 of an umbrella 20 and the base 12 is weighted for enhancing stability of the base 12 when the pole 18 of the umbrella 20 is inserted into the opening 16. The umbrella 20 may be an outdoor umbrella commonly employed to provide shade during sunny conditions. The base 12 has a bottom wall 22, a top wall 24 and an outer wall 26 extending between the top wall 24 and the bottom wall 22; the outer wall 26 slopes outwardly between the top wall 24 and the bottom wall 22 and the outer wall 26 is continuously arcuate about a central axis of the base 12 such that the base 12 has a frusto-conical shape.

The base 12 is substantially hollow and the opening 16 extends through the top wall 24 into an interior of the base 12. The opening 16 is centrally positioned on the top wall 24 and the opening 16 has a bounding edge 28. The outer wall 26 has a slot 30 extending from the top wall 24 toward the bottom wall 22 and the slot 30 intersects the bounding edge 28 of the opening 16 and the base 12 has a plurality of first pivot points 32 each extending upwardly from the bottom wall 22. The plurality of first pivot points 32 is arranged to form a circle that is aligned with the opening 16 in the top wall 24. The base 12 has a second pivot point 34 extending away from the outer wall 26 such that the second pivot point 34 is positioned inside the base 12. The second pivot point 34 is aligned with an intersection between the outer wall 26 and the top wall 24. A stem 36 extends upwardly from the bottom wall 22 of the base 12 such that the stem 36 is positioned inside the base 12 and the stem 36 is aligned with the opening 16 in the top wall 24 of the base 12.

A gripping unit 38 is movably integrated into the base 12 and the gripping unit 38 is aligned with the opening 16. The gripping unit 38 is biased into a gripping position having the gripping unit 38 engaging the pole 18 of the umbrella 20 for retaining the pole 18 in the base 12. The gripping unit 38 is urgeable into a releasing position having the gripping unit 38 being disengaged from the pole 18 thereby facilitating the pole 18 to be removed from the base 12. The gripping unit 38 comprises a disk 40 which has an aperture 42 extending through a top surface 44 and a bottom surface 46 of the disk 40. The aperture 42 is centrally located on the disk 40 and the stem 36 extends through the aperture 42. The disk 40 has a pair of receivers 48 each extending upwardly from the top surface 44. Each of the receivers 48 is aligned with a perimeter edge 49 of the disk 40 and each of the receivers 48 has a pin slot 50.

The gripping unit 38 includes a plurality of arms 52 that each has a first end 54 and a second end 56. Each of the arms 52 has a bend 58 that is positioned closer to the first end 54 than the second end 56 to define a first section 60 of the arms 52 forming an angle with a second section 62 of the arms 52. The first section 60 is associated with the first end 54 and the second section 62 is associated with the second end 56. The first end 54 of each of the arms 52 is pivotally coupled to a respective one of a plurality of first pivot points 32 on the bottom wall 22 of the base 12 having the second section 62 of each of the arms 52 being directed toward each other. The second section 62 of each of the arms 52 extends upwardly through the opening 16 in the top wall 24 of the base 12. Each of the arms 52 has a knob 64 extending away from the first section 60, the knob 64 on each of the arms 52 is positioned adjacent to the bend 58 and the knob 64 on each of the arms 52 is directed toward the bottom wall 22 of the base 12. The second section 62 of each of the plurality of arms 52 abuts the perimeter edge 49 of the disk 40.

The gripping unit 38 includes a plurality of panels 66 that each has a first surface 68 which is bonded to the second section 62 of a respective one of the arms 52. Each of the plurality of panels 66 is positioned adjacent to the second end 56 of the respective arm 52. Furthermore, each of the plurality of panels 66 is curved such that each of the plurality of panels 66 forms a half-pipe shape curving away from the respective arm 52. The gripping unit 38 includes a plurality of biasing members 70 and each of the biasing members 70 extends between the first section 60 of a respective one of the plurality of arms 52 and the bottom wall 22 of the base 12. Each of the biasing members 70 is positioned around the knob 64 on the first section 60 of the respective arm 52. Additionally, the plurality of biasing members 70 biases the second section 62 of the plurality of arms 52 toward each other such that each of the plurality of panels 66 compresses against the pole 18 of the umbrella 20.

A foot pedal 72 is movably attached to the gripping unit 38 and the foot pedal 72 can be stepped upon by a user 74. The foot pedal 72 urges the gripping unit 38 into the releasing position when the foot pedal 72 is urged downwardly to facilitate the gripping unit 38 to be disengaged from the pole 18 without requiring the user 74 to bend over to manipulate the gripping unit 38. The foot pedal 72 comprises a pedal member 76 that is perpendicularly oriented with a central member 78 of a yoke 80 having a pair of outward members 82 of the yoke 80 extending away from the pedal member 76. The pedal member 76 extends through the slot 30 in the outer wall 26 of the base 12 and the pedal member 76 is pivotally attached to the second pivot point 34 on the outer wall 26 of the base 12. The yoke 80 has a pair of pins 84 each extending laterally away from a respective one of the outward members 82. Each of the pins 84 extends through the pin slot 50 in a respective one of the receivers 48 on the disk 40 thereby pivotally attaching the yoke 80 to the disk 40.

The foot pedal 72 includes a plate 86 that is attached to a distal end 88 of the pedal member 76 to facilitate the plate 86 to be stepped upon. The disk 40 is positioned adjacent to the bend 58 in each of the plurality of arms 52 when the plurality of arms 52 is biased toward each other. The disk 40 is lifted upwardly on the stem 36 thereby facilitating the disk 40 to urge the second section 62 of each of the plurality of arms 52 away from each other when the pedal member 76 is urged downwardly. In this way the plurality of arms 52 is urged away from each other to facilitate the pole 18 to be removed from the base 12.

In use, the foot pedal 72 is stepped upon to urge the gripping unit 38 into the releasing position and the pole 18 of the umbrella 20 is inserted into the opening 16 in the base 12. The foot pedal 72 is released and the gripping unit 38 is biased into the gripping position to grip the pole 18. In this way the umbrella 20 is secured into the base 12 without requiring the user 74 to bend over and manipulate a screw, for example, that is commonly required on existing umbrella bases. The foot pedal 72 is stepped upon for urging the gripping unit 38 into the releasing position to facilitate the pole 18 to be removed from the base 12. In this way the pole 18 can be quickly inserted into the base 12 or removed from the base 12 without requiring the user 74 to bend over.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An umbrella stand assembly for gripping or releasing an umbrella, said assembly comprising:

a base being positionable on a support surface, said base having an opening for insertably receiving a pole of an umbrella, said base being weighted for enhancing stability of said base when said pole of said umbrella is inserted into said opening;

a gripping unit being movably integrated into said base, said gripping unit being aligned with said opening, said gripping unit being biased into a gripping position having said gripping unit engaging said pole of said umbrella for retaining said pole in said base, said gripping unit being urgeable into a releasing position having said gripping unit being disengaged from said pole thereby facilitating said pole to be removed from said base; and a foot pedal being movably attached to said gripping unit wherein said foot pedal is configured to be stepped upon by a user, said foot pedal urging said gripping unit into said releasing position when said foot pedal is urged downwardly wherein said foot pedal is configured to facilitate said gripping unit to be disengaged from said pole without requiring the user to bend over to manipulate said gripping unit;

wherein said base has a bottom wall, a top wall and an outer wall extending between said top wall and said bottom wall, said outer wall sloping outwardly between said top wall and said bottom wall having said outer wall being continuously arcuate about a central axis of said base such that said base has a frusto-conical shape, said base being substantially hollow, said opening extending through said top wall into an interior of said base, said opening being centrally positioned on said top wall, said opening having a bounding edge;

wherein said outer wall has a slot extending from said top wall toward said bottom wall, said slot intersecting said bounding edge of said opening;

wherein said base having a plurality of first pivot points each extending upwardly from said bottom wall, said plurality of first pivot points being arranged to form a circle being aligned with said opening in said top wall;

wherein said base having a second pivot point extending away from said outer wall such that said second pivot point is positioned inside said base, said second pivot point being aligned with an intersection between said outer wall and said top wall; and wherein said assembly includes a stem extending upwardly from said bottom wall of said base such that said stem is positioned inside said base, said stem being aligned with said opening in said top wall of said base.

2. The assembly according to claim 1, wherein said gripping unit comprises a disk having an aperture extending through a top surface and a bottom surface of said disk, said aperture being centrally located on said disk, said stem extending through said aperture, said disk having a pair of receivers each extending upwardly from said top surface, each of said receivers being aligned with a perimeter edge of said disk, each of said receivers having a pin slot.

3. The assembly according to claim 2, wherein said foot pedal comprises a pedal member being perpendicularly oriented with a central member of a yoke having a pair of outward members of said yoke extending away from said pedal member, said yoke having a pair of pins each extending laterally away from a respective one of said outward members, each of said pins extending through said pin slot in a respective one of said receivers on said disk thereby pivotally attaching said yoke to said disk.

4. The assembly according to claim 3, wherein said pedal member extends through said slot in said outer wall of said base, said foot pedal having a plate being attached to a distal end of said pedal member wherein said plate is configured to be stepped upon, said pedal member being pivotally attached to second pivot point on said outer wall of said base.

5. The assembly according to claim 3, wherein said disk is positioned adjacent to a bend in each of said plurality of arms when said plurality of arms is biased toward each other, said disk being lifted upwardly on said stem thereby facilitating said disk to urge said second section of each of said plurality of arms away from each other when said pedal member is urged downwardly thereby urging said plurality of arms away from each other to facilitate said pole to be removed from said base.

6. The assembly according to claim 1, wherein said gripping unit includes a plurality of arms, each of said arms having a first end and a second end, each of said arms having a bend being positioned closer to said first end than said second end to define a first section of said arms forming an angle with a second section of said arms, said first section being associated with said first end, said second section being associated with said second end, said first end of each of said arms being pivotally coupled to a respective one of a plurality of first pivot points on said bottom wall of said base having said second section of each of said arms being directed toward each other, said second section of each of said arms extends upwardly through said opening in said top wall of said base, said second section of each of said plurality of arms abutting said perimeter edge of said disk.

7. The assembly according to claim 6, wherein each of said arms has a knob extending away from said first section, said knob on each of said arms being positioned adjacent to said bend, said knob on each of said arms being directed toward said bottom wall of said base.

8. The assembly according to claim 6, wherein said gripping unit includes a plurality of panels, each of said plurality of panels having a first surface being bonded to said second section of a respective one of said arms, each of said plurality of panels being positioned adjacent to said second end of said respective arm, each of said plurality of panels being curved such that each of said plurality of panels forms a half-pipe shape curving away from said respective arm.

9. The assembly according to claim 8, wherein said gripping unit includes a plurality of biasing members, each of said biasing members extending between said first section of a respective one of said plurality of arms and said bottom wall of said base, said plurality of biasing members biasing said second section of said plurality of arms toward each other such that each of said plurality of panels compresses against said pole of said umbrella.

10. An umbrella stand assembly for gripping or releasing an umbrella, said assembly comprising:

a base being positionable on a support surface, said base having an opening for insertably receiving a pole of an umbrella, said base being weighted for enhancing stability of said base when said pole of said umbrella is inserted into said opening, said base having a bottom wall, a top wall and an outer wall extending between said top wall and said bottom wall, said outer wall sloping outwardly between said top wall and said bottom wall having said outer wall being continuously arcuate about a central axis of said base such that said base has a frusto-conical shape, said base being substantially hollow, said opening extending through said top wall into an interior of said base, said opening being centrally positioned on said top wall, said opening having a bounding edge, said outer wall having a slot extending from said top wall toward said bottom wall, said slot intersecting said bounding edge of said opening, said base having a plurality of first pivot points each extending upwardly from said bottom wall, said plurality of first pivot points being arranged to form a circle being aligned with said opening in said top wall, said base having a second pivot point extending away from said outer wall such that said second pivot point is positioned inside said base, said second pivot point being aligned with an intersection between said outer wall and said top wall;

a stem extending upwardly from said bottom wall of said base such that said stem is positioned inside said base, said stem being aligned with said opening in said top wall of said base;

a gripping unit being movably integrated into said base, said gripping unit being aligned with said opening, said gripping unit being biased into a gripping position having said gripping unit engaging said pole of said umbrella for retaining said pole in said base, said gripping unit being urgeable into a releasing position having said gripping unit being disengaged from said pole thereby facilitating said pole to be removed from said base, said gripping unit comprising:

a disk having an aperture extending through a top surface and a bottom surface of said disk, said aperture being centrally located on said disk, said stem extending through said aperture, said disk having a pair of receivers each extending upwardly from said top surface, each of said receivers being aligned with a perimeter edge of said disk, each of said receivers having a pin slot;

a plurality of arms, each of said arms having a first end and a second end, each of said arms having a bend being positioned closer to said first end than said second end to define a first section of said arms forming an angle with a second section of said arms, said first section being associated with said first end, said second section being associated with said second end, said first end of each of said arms being pivotally coupled to a respective one of a plurality of first pivot points on said bottom wall of said base having said second section of each of said arms being directed toward each other, said second section of each of said arms extending upwardly through said opening in said top wall of said base, each of said arms having a knob extending away from said first section, said knob on each of said arms being positioned adjacent to said bend, said knob on each of said arms being directed toward said bottom wall of said base;

a plurality of panels, each of said plurality of panels having a first surface being bonded to said second section of a respective one of said arms, each of said plurality of panels being positioned adjacent to said second end of said respective arm, each of said plurality of panels being curved such that each of said plurality of panels forms a half-pipe shape curving away from said respective arm; and a plurality of biasing members, each of said biasing members extending between said first section of a respective one of said plurality of arms and said bottom wall of said base, each of said biasing members being positioned around said knob on said first section of said respective arm, said plurality of biasing members biasing said second section of said plurality of arms toward each other such that each of said plurality of panels compresses against said pole of said umbrella, said second section of each of said plurality of arms abutting said perimeter edge of said disk; and a foot pedal being movably attached to said gripping unit wherein said foot pedal is configured to be stepped upon by a user, said foot pedal urging said gripping unit into said releasing position when said foot pedal is urged downwardly wherein said foot pedal is configured to facilitate said gripping unit to be disengaged from said pole without requiring the user to bend over to manipulate said gripping unit, said foot pedal comprising a pedal member being perpendicularly oriented with a central member of a yoke having a pair of outward members of said yoke extending away from said pedal member, said yoke having a pair of pins each extending laterally away from a respective one of said outward members, each of said pins extending through said pin slot in a respective one of said receivers on said disk thereby pivotally attaching said yoke to said disk, said pedal member extending through said slot in said outer wall of said base, said foot pedal having a plate being attached to a distal end of said pedal member wherein said plate is configured to be stepped upon, said pedal member being pivotally attached to second pivot point on said outer wall of said base, said disk being positioned adjacent to said bend in each of said plurality of arms when said plurality of arms is biased toward each other, said disk being lifted upwardly on said stem thereby facilitating said disk to urge said second section of each of said plurality of arms away from each other when said pedal member is urged downwardly thereby urging said plurality of arms away from each other to facilitate said pole to be removed from said base.

* * * * *